US009097486B1

(12) United States Patent
Huang

(10) Patent No.: US 9,097,486 B1
(45) Date of Patent: Aug. 4, 2015

(54) ARCHERY BOW CAM STRING STOP

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 0 days.

(21) Appl. No.: 14/296,486

(22) Filed: Jun. 5, 2014

(51) Int. Cl.
*F41B 5/10* (2006.01)
*F41B 5/14* (2006.01)

(52) U.S. Cl.
CPC ..... *F41B 5/1403* (2013.01); *F41B 5/105* (2013.01)

(58) Field of Classification Search
CPC ..... F41B 5/10; F41B 5/105; F41B 5/14
See application file for complete search history.

(56) References Cited

U.S. PATENT DOCUMENTS 7,671,925 B2 * 3/2010 Lim et al. ..... 348/609
7,721,724 B2 * 5/2010 Goade ..... 124/89
8,544,456 B2 * 10/2013 Grace ..... 124/25.6
8,720,425 B2 * 5/2014 Strother ..... 124/25.6
2012/0076611 A1 * 3/2012 Bryan ..... 411/204
2013/0068206 A1 * 3/2013 Langley ..... 124/25.6
2014/0283807 A1 * 9/2014 Prater ..... 124/25.6
2014/0366858 A1 * 12/2014 Garver et al. ..... 124/25.6
2015/0068051 A1 * 3/2015 Adams et al. ..... 33/265

* cited by examiner

*Primary Examiner* — John Ricci
(74) *Attorney, Agent, or Firm* — Donald J. Ersler

(57) ABSTRACT

An archery bow cam string stop includes a titanium stop, a titanium fastener and an impact portion. The titanium stop includes an elongated body. A female thread is tapped in one end of the titanium stop and a counter bore is formed in an opposing end thereof. The counter bore reduces the weight of the titanium stop. Two parallel flats are formed on opposing sides of the elongated body, adjacent the female thread to receive an open-end wrench. A cross-sectional shape of the elongated body is preferably round. The impact portion is preferably a plurality of o-rings. The plurality of o-rings are slid over an outer perimeter of the elongated body. In use, a threaded end of the titanium fastener is inserted through a stop slot in the string cam. The threaded end is threaded into the female thread and tightened to retain the titanium in position.

12 Claims, 2 Drawing Sheets

ARCHERY BOW CAM STRING STOP

BACKGROUND OF THE INVENTION

1. Field of the Invention

The present invention relates generally to archery and more specifically to an archery bow cam string stop, which is lighter and stronger than that of the prior art.

2. Discussion of the Prior Art

It is advantageous to reduce the weight of an archery bow to make it easier to use over a long period of time. It appears that the prior art does not teach or suggest a cam stop fabricated mostly from titanium.

Accordingly, there is a clearly felt need in the art for an archery bow cam string stop, which is lighter and stronger than that of the prior art and has the unexpected result of either increasing the speed of an arrow shot from the archery bow, or providing a more efficient transfer of kinetic energy from the bow to the arrow.

SUMMARY OF THE INVENTION

The present invention provides an archery bow cam string stop, which is lighter and stronger than that of the prior art. The archery bow cam string stop preferably includes a titanium stop, a titanium fastener and an impact portion. The titanium stop includes an elongated body. A female thread is tapped into one end of the titanium stop and a counter bore is formed in an opposing end thereof. The counter bore reduces the weight of the titanium stop. In a first embodiment, two parallel flats are formed by removing material from opposing sides of the elongated body, adjacent the female thread to receive an open-end wrench.

A second embodiment of the titanium stop includes an elongated body. A stop shoulder extends from an outer perimeter of the elongated body at one end thereof. Two parallel flats are cut in opposing sides of the stop shoulder of the elongated body to receive an open-end wrench. A cross-sectional shape of the elongated body is preferably round. The impact portion is preferably a plurality of o-rings, but other impact portions may be used, such as a single exterior sleeve. The plurality of o-rings are slid over an outer perimeter of the elongated body. In use, a threaded end of the titanium fastener is inserted through a stop slot in the string cam. The threaded end is threaded into the female thread and tightened to retain the titanium in position.

Accordingly, it is an object of the present invention to provide an archery bow cam string stop, which is lighter and stronger than that of the prior art.

Finally, it is another object of the present invention to provide an archery bow cam string stop, which has the unexpected result of increasing the speed of an arrow shot from the archery bow, or providing a more efficient transfer of kinetic energy from the bow to the arrow.

These and additional objects, advantages, features and benefits of the present invention will become apparent from the following specification.

DETAILED DESCRIPTION OF THE PREFERRED EMBODIMENTS

Figure 1:
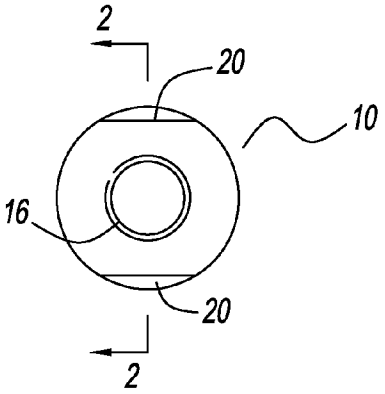
FIG. 1 is an end view of a first embodiment of a titanium stop of an archery bow cam string stop in accordance with the present invention.
Figure 2:
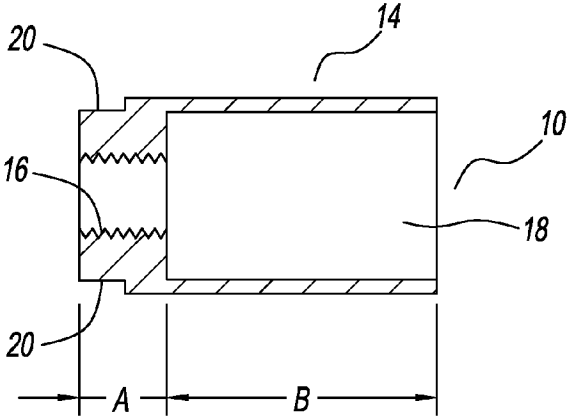
FIG. 2 is a cross-sectional view of a first embodiment of a titanium stop cut through FIG. 1 of an archery bow cam string stop in accordance with the present invention.
Figure 5:
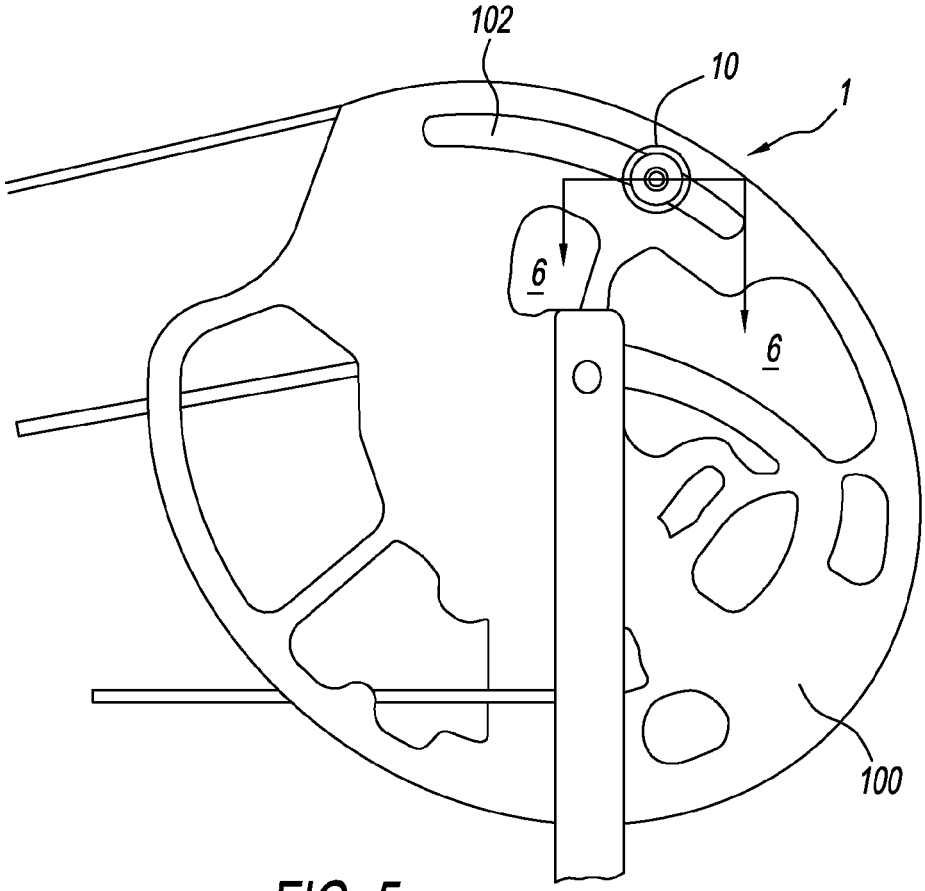
FIG. 5 is a top view of an archery bow cam string stop attached to a string cam of an archery bow in accordance with the present invention.
Figure 6:
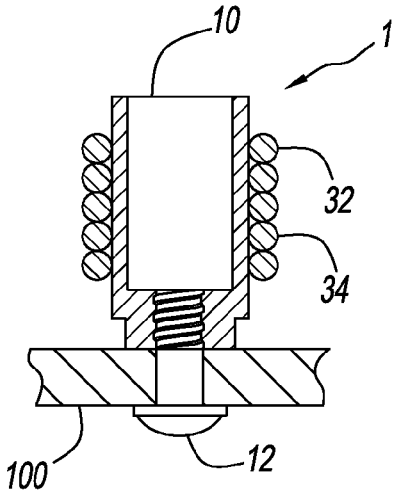
FIG. 6 is a cross sectional view of an archery bow cam string stop cut through FIG. 5 and attached to a string cam of an archery bow in accordance with the present invention.

With reference now to the drawings, and particularly to FIG. 5, there is shown a top view of an archery bow cam string stop 1 attached to a string cam 100 of an archery bow. With reference to FIG. 6, the archery bow cam string stop 1 includes a titanium stop 10, a titanium fastener 12 and an impact portion. With reference to FIGS. 1-2, the titanium stop 10 includes an elongated body 14. A female thread 16 is tapped into one end of the titanium stop 10 and a counter bore 18 is formed in an opposing end thereof. The counter bore 18 reduces the weight of the titanium stop 10. Two parallel flats 20 are formed by removing material from opposing sides of the elongated body 14, adjacent the female thread 16 to receive an open-end wrench. A depth "B" of the counter bore 18 is preferably at least twice a length "A" of the female thread 16.

Figure 3:
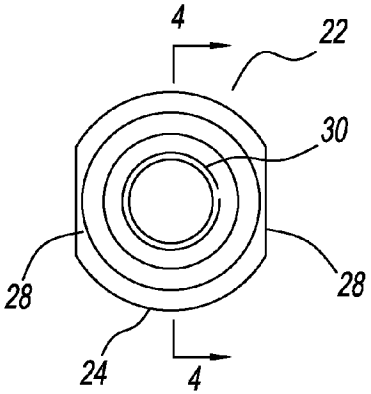
FIG. 3 is an end view of a second embodiment of a titanium stop of an archery bow cam string stop in accordance with the present invention.
Figure 4:
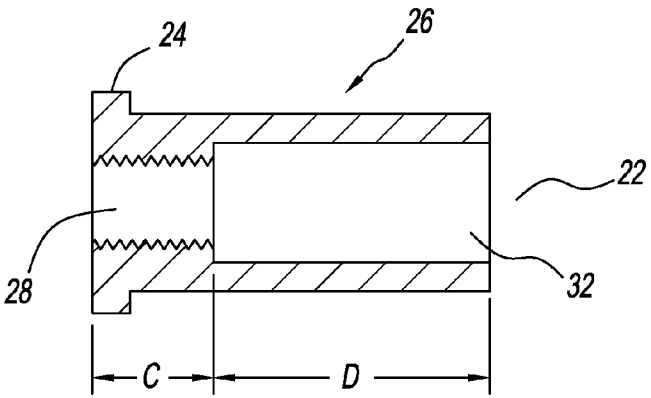
FIG. 4 is a cross-sectional view of a second embodiment of a titanium stop cut through FIG. 3 of an archery bow cam string stop in accordance with the present invention.

With reference to FIGS. 3-4, a second embodiment of a titanium stop 22 is shown. The titanium stop 22 includes an elongated body 26. A stop shoulder 24 extends from an outer perimeter of the elongated body 26 at one end thereof. Two parallel flats 28 are cut in opposing sides of the stop shoulder 24 of the elongated body 26 to receive an open-end wrench. A female thread 30 is tapped into the one end of the titanium stop 22 and a counter bore 32 is formed in an opposing end thereof. A cross-sectional shape of the elongated body 14, 26 is preferably round. A depth "D" of the counter bore 30 is preferably at least twice a length "C" of the female thread 28.

The impact portion is preferably a plurality of o-rings 34, but other impact portions may be used, such as a single exterior sleeve. The impact sleeve and plurality of o-rings 32 have resilient properties. The plurality of o-rings 34 are slid over an outer perimeter of the elongated body 14, 26. It is preferable to use Grade 5 titanium for the titanium stop 10, 22 and the titanium fastener 12. In use, a threaded end of the titanium fastener 12 is inserted through a stop slot 102 in the archery cam 100. The threaded end of the titanium fastener 12 is threaded into the female thread 16 and tightened to retain the titanium stop 10, 22 in position, relative to the string cam 100. The archery bow cam string stop 1 has the unexpected result of allowing an arrow to be propelled from the archery bow at an increased speed of between 6-8 miles per hour. Alternatively, the archery bow cam string stop 1 may have the unexpected result of providing a more efficient transfer of kinetic energy from the bow to the arrow.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An archery bow cam string stop comprising:

a titanium stop includes an elongated body, a female thread is formed in one end of the elongated body, a counter bore is formed in an opposing end of the elongated body, said counter bore has an outer perimeter that is greater than an outer perimeter of said female thread, a length of said counter bore is greater than a length of said female thread; and a titanium fastener having a threaded end, wherein said threaded end is inserted through a slot of a string cam of an archery bow, said threaded end is threaded into said female thread and tightened.

2. The archery bow cam string stop of claim 1 wherein:

said titanium stop and said titanium fastener are fabricated from grade 5 titanium.

3. The archery bow cam string stop of claim 1 wherein:

a depth of said counter bore is at least twice a length of said female thread.

4. An archery bow cam string stop comprising:

a titanium stop includes an elongated body, a female thread is formed in one end of the elongated body, a counter bore is formed in an opposing end of the elongated body, said counter bore has an outer perimeter that is greater than an outer perimeter of said female thread, a length of said counter bore is greater than a length of said female thread, two parallel flats are formed on opposing sides of said elongated body; and a titanium fastener having a threaded end, wherein said threaded end is inserted through a slot of a string cam of an archery bow, said threaded end is threaded into said female thread and tightened.

5. The archery bow cam string stop of claim 4 wherein:

said titanium stop and said titanium fastener are fabricated from grade 5 titanium.

6. The archery bow cam string stop of claim 4 wherein:

a depth of said counter bore is at least twice a length of said female thread.

7. The archery bow cam string stop of claim 4 wherein:

said two parallel flats are formed by removing material from said elongated body, adjacent said female thread.

8. The archery bow cam string stop of claim 4 wherein:

a shoulder is formed on said one end of said elongated body, said two parallel flats are formed by removing material from said stop shoulder.

9. An archery bow cam string stop comprising:

a titanium stop includes an elongated body, a female thread is formed in one end of the elongated body, a counter bore is formed in an opposing end of the elongated body, said counter bore has an outer perimeter that is greater than an outer perimeter of said female thread, a length of said counter bore is greater than a length of said female thread;

an impact portion is retained around at least a portion of a perimeter of said elongated body, said impact portion having resilient properties; and a titanium fastener having a threaded end, wherein said threaded end is inserted through a slot of a string cam of an archery bow, said threaded end is threaded into said female thread and tightened.

10. The archery bow cam string stop of claim 9 wherein:

said titanium stop and said titanium fastener are fabricated from grade 5 titanium.

11. The archery bow cam string stop of claim 9 wherein:

a depth of said counter bore is at least twice a length of said female thread.

12. The archery bow cam string stop of claim 9 wherein:

said impact portion is a plurality of o-rings.

* * * * *